United States Patent [19]

Moore et al.

[11] Patent Number: 4,725,254

[45] Date of Patent: Feb. 16, 1988

[54] METHOD FOR MANUFACTURING A CENTER ELECTRODE FOR A SPARK PLUG

[75] Inventors: David J. Moore, Fostoria; William A. Barrett, Bradner, both of Ohio

[73] Assignee: Allied Corporation, Morristown, N.J.

[21] Appl. No.: 934,514

[22] Filed: Nov. 24, 1986

[51] Int. Cl.[4] ..... H01T 21/02

[52] U.S. Cl. ..... 445/7; 313/141

[58] Field of Search ..... 445/7; 313/141

[56] References Cited

U.S. PATENT DOCUMENTS

| | | | |
|---|---|---|---|
| 2,296,033 | 9/1942 | Heller | 445/7 X |
| 3,548,472 | 12/1970 | Urushiwara et al. | 445/7 |
| 4,122,366 | 10/1978 | von Stutterheim | 313/141 |
| 4,540,910 | 9/1985 | Kondo et al. | 313/141 X |
| 4,575,343 | 3/1986 | Kin et al. | 445/7 |
| 4,581,558 | 4/1986 | Takamura et al. | 313/141 |
| 4,670,684 | 6/1987 | Kagawa et al. | 313/141 |
| 4,684,352 | 8/1987 | Clark et al. | 445/7 |

*Primary Examiner*—Kenneth J. Ramsey

*Attorney, Agent, or Firm*—Leo H. McCormick, Jr.; Ken C. Decker

[57] ABSTRACT

A method of manufacturing an electrode (20) for a spark plug (32) wherein a platinum cup member or (54) cap is attached to a tip (12) that extends from an extruded inconel body (10). The inconel body (10) is sequentially extruded from a cylindrical blank to produce a tip (12) on a first end (12) and a cup shaped (16) opening that extends from a second end (14) toward the first end (12). A copper core (18) is inserted into the cup (16) and the cylindrical blank (10) thereafter extruded to a substantially final length for the resulting center wire (20). In order to assure a uniform thickness, a source of platinum (38) is roller into a thin strip and a (44) disc is punched therefrom. The disc (44) is formed into a cap member (54) which has the shape of a cup . The resulting cap member (54) and center wire (20) are placed in a fixture and the cap member (54) is moved toward the center wire (20) until the cap member surrounds the tip (12). Thereafter electrical current is passed through the cylindrical body (20) and cap member (54). The electrical current is terminated when the thermal energy heats the inconel adjacent the junction to its melting point. A compressive force is maintained on the center wire (20) and cap member (54) causing the cap member to fuse to the tip (12) and complete the manufacture of the electrode (20).

8 Claims, 13 Drawing Figures

METHOD FOR MANUFACTURING A CENTER ELECTRODE FOR A SPARK PLUG

The invention relates to a method of making the center electrode for a spark plug.

Spark plugs are used in internal combustion engines to ignite the fuel in the combustion chamber. Hence, the electrodes of a spark plug are subject to intense heat and an extremely corrosive atmosphere. To provide some degree of longevity for the spark plug, the center electrode is made from a good heat conducting material such as copper surrounded by a jacket of a corrosion resistant material such as nickel.

The manufacture of copper and nickel electrodes for spark plugs has been accomplished in a variety of ways. For instance, U.S. Pat. No. 3,803,892 issued Apr. 16, 1974 and entitled "Method of Producing Spark Plug Center Electrode" describes a method of extruding copper and nickel electrodes from a flat plate of the two materials. U.S. Pat. No. 2,261,436 issued Nov. 4, 1941 and entitled "Spark Plug and Method of Making the Same" illustrates how copper and nickel is swaged into a single long wire and then cut to smaller lengths for use as electrodes in a spark plug. U.S. Pat. No. 3,548,472 issued Dec. 22, 1970 and entitled "Ignition Plug and Method for Manufacturing a Center Electrode for the Same" illustrates a method of cold forming an outer nickel cup shaped sleeve by several steps and then inserting a piece of copper wire into the cup and then lightly pressing the two materials together.

U.S. Pat. No. 3,857,145 issued Dec. 31, 1974 and entitled "Method of Producing Spark Plug Center Electrode" discloses a process whereby a copper center is inserted into a nickel member and attached thereto by a collar portion to assure that an electrical flow path is produced.

The spark plug electrodes produced by the methods disclosed above performed in a satisfactory manner when used in vehicles that were manufactured prior to the implementation of the clean air act of 1977 in the United States. After 1977, with modifications to engines and fuel, the operating temperature of most vehicles increased. As a result of the changes in the engines and fuel, some of the operating components in engines have been subjected to the corrosive effects of exhaust gases. Thus even though nickel center electrodes for spark plugs are resistant to most oxides, after a period of time of operating at higher temperatures and recirculation gases, some corrosion can occur. Once corrosion has taken place, the electrical flow path deteriorates which can result in lower fuel efficiency.

In copending U.S. patent application No. 934,512, filed concurrently herewith and now U.S. Pat. No. 4,705,486, a method of manufacturing an electrode is disclosed wherein a platinum disc is welded to the tip of an inconel center wire. Thereafter, the center wire is placed in a die and extruded to a final desired length such that the platinum covers the weld to prevent deterioration of the electrical flow path between the center wire and platinum disc during normal operation when used in a spark plug.

In an effort to reduce the manufacturing cost of an electrode, we have developed a method of manufacture whereby an inconel center wire with a copper core are extruded to a desired length. A platinum ribbon is rolled to a desired thickness and disc punched therefrom. The disc has a cup shape with a peripheral flange. The disc and center wire are placed in a fixture and moved toward each other such that the disc surrounds the tip. Thereafter electrical current is passed through the center wire and disc. As electrical current flows from the tip of the inconel to the platinum disc an arc occurs which results in the generation of thermal energy. The flow of current continues until the thermal energy is sufficient to melt the inconel at the junction between the tip and disc. Thereafter the electrical current is terminated. A compressive force which is maintained on the disc causes the inconel tip to fuse with the end cap and form a metallurgical bond or joint to complete the manufacture of the electrode.

An advantage that this method of manufacturing an electrode offers is the platinum end cap member is extruded to a desired shape to uniformly cover a tip on a center wire.

It is an object of this invention to provide a method of manufacturing an electrode for a spark plug having a center wire with a platinum cap metallurgically bonded to an extruded tip.

These objects, and others should be obvious from reading this specification and viewing the drawing wherein.

Figure 1:
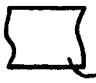
FIG. 1 is a cylindrical blank cut from a source of inconel wire.

The method of manufacturing an electrode for a spark plug is illustrated by the various steps set forth in the drawings of which FIG. 1 illustrates a piece of corrosion resistant metal wire having a dimension of about 0.139 ×0.2" which is cut from a spool or rod. A preferred corrosion resistant alloy is inconel which is an iron alloy containing nickel and chromium. One such inconel metal, known as Hoskins Alloy 831, contains 75% nickel, 15% chromium and 7% iron.

Figure 2:
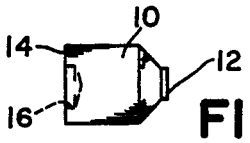
FIG. 2 is a view of the cylindrical blank of FIG. 1 which has been extruded to define a tin on a first end, an indentation on a second end.
Figure 3:
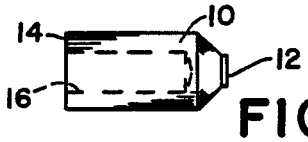
FIG. 3 is a view of the blank of FIG. 2 wherein the indentation has been elongated by a further extrusion step.
Figure 4:
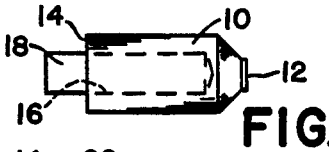
FIG. 4 is a view of the blank of FIG. 3 with a copper core inserted into the cup defined by the indentation.
Figure 5:
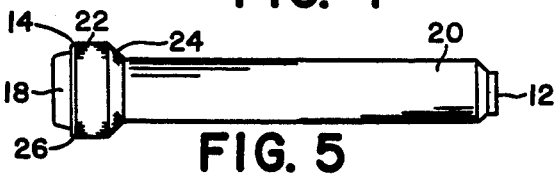
FIG. 5 is a view of the blank of FIG. 4 which has been extruded to a final desired length to define a center wire.
Figure 6:
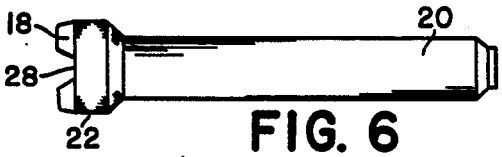
FIG. 6 is a view of the center wire of FIG. 5 with cross slot formed in the copper core center.

Before placing a piece of inconel wire 10 into a die it is coated with a standard cold heading lubricant. Such a lubricant is a lubricating oil with extreme pressure additives; sulphur, chlorine and neutral animal fat. It is most often a combination of sulphurized fat and a chlorine additive and is available from a good number of lubricant manufacturers. Lubrication is vital in cold heading to reduce die wear, promote good finishes and eliminate galling, scratching and seizing of the work piece by preventing pickups by the dye. During the cold heading operation, the sulphur and chlorine components of the lubricant form ferrous sulphides and chlorides which prevent welding of the die to the work piece and act in the same way as a solid lubricant. An example of one such lubricating oil is TUF-DRAW 21334 made by the Franklin Oil Corporation of Ohio. After the wire 10 is cut into a blank as shown in FIG. 1 and lubricated, it is taken to a first die where the first 12 and second 14 ends are squared to define flat surfaces and end 12 is extruded to produce a tip while an indentation 15 is formed in end 14 as shown in FIG. 2. The cylindrical blank 10 is transported to a second die and further extruded to develop a center bore 16 that extends from extrusion 15, as shown in FIG. 3. After a copper core 18 is inserted in bore 16, as shown in FIG. 4, the cylindrical blank 10 is transported to a third die and further extruded to a predetermined length as shown in FIG. 5 to produce a center wire 20. Center wire 20 has a shoulder 22 with a tapered surface 24 and a lip 26.

The center wire 20 is removed from the third die and carried to a station where cross 28 is formed into the copper core 18 to complete its manufacture. A center wire 20 manufactured according to the procedure set forth above could be inserted into the porcelain body 30 of a spark plug 32 of a type shown in FIG. 13. This type center wire 20 would adequately perform under most operating conditions and meet the life requirements for current automobiles.

Figure 7:
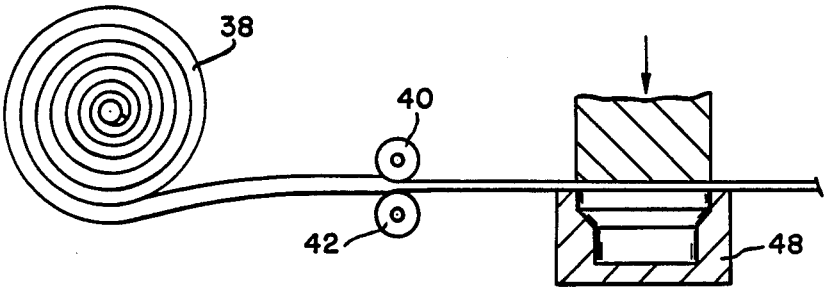
FIG. 7 is a schematic view of an operation whereby a ribbon of platinum is reduced to a desired thickness and disc punched therefrom.
Figure 8:
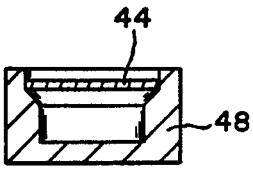
FIG. 8 is a view of a die whereby a platinum disc is shaped into a cup shaped member.
Figure 9:
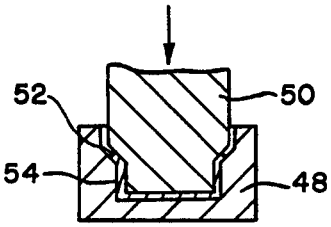
FIG. 9 is a view of the plantinum disc of FIG. 8 with a flange on its peripheral surface.

In order to extend the life of an electrode by reducing or eliminating the development of oxides on the tip or end 12 we have added a thin layer of platinum on the tip of the electrode 20. As shown in FIG. 7 a ribbon or roll 38 of platinum having an initial thickness of 0.003" is carried through a pair of rollers 40 and 42 to establish a uniform thickness. If the thickness of the platinum roll 38 from a source is uniform and the desired thickness, this roller step may not be necessary. However the cost of platinum dictates that the smallest thickness that will protect the inconel tip 12 is what should be used. We have found this thickness to be about 0.003 inches. The uniform roll 38 passes through a punching operation where a disc 44 is produced and placed in a die 48 as shown in FIG. 8. Die 48 is transferred to a station where a disc 44 is shaped into a cup like member 54 by ram press 50. When the ram press 50 is in the final position, a flange 52 is formed on the peripheral surface of the lip member 54 as shown in FIG. 9.

Figure 10:
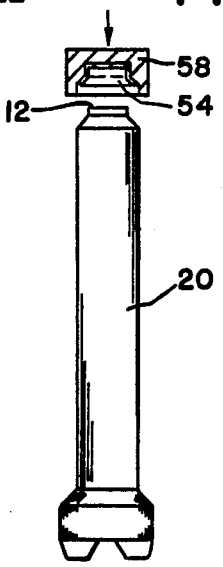
FIG. 10 is a view of a fixture station where the platinum disc is aligned with the tip of the center wire.

After the end member or cap 54 has been manufactured it has an overall uniform thickness of about 0.002". The end member or cap 54 is placed in a fixture 58 and taken to a station and aligned with a center wire 20 as illustrated by FIG. 10. Prior to center wire 20 being placed in the fixture illustrated at FIG. 10 at least tip 12 is passed through a cleaning station where oil and any oxides thereon are removed which may effect the later development of a bond with the platinum cap 54.

Figure 11:
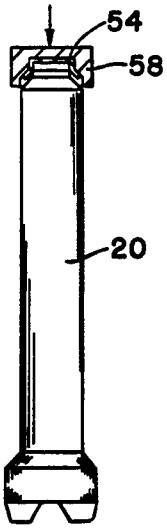
FIG. 11 is a view of the platinum disc attached to the center wire.

At this fixture, end member or cap 54 is moved toward and frictionally engages the center wire 20 to form a mechanical bond between the platinum inner surface of the cap 54 and tip 12 as shown in FIG. 11.

Under some circumstances it may be possible to place a disc 44 in a die and use the tip 12 as the forming tool. This is possible because of the relative thickness of the platinum and strength of the already formed tip 12 on the inconel body of the center wire 20. However some concern may exist with respect to the uniform thickness of the resulting end member that is produced and as a result it is preferable to separately produce the end cap 54.

Figure 12:
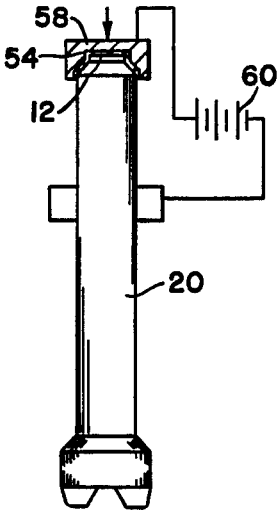
FIG. 12 is a view of a station where the inconel center wire is fused to the platinum disc.

In any event whichever process step is used, tip 12 is covered with an end cap of platinum. The center wire 20 with platinum end cap 54 is transferred to a welding fixture illustrated in FIG. 12. At this station, electrical current flows from source 60 through the inconel body 20 into the platinum cap 54 to fixture 58 which is connected to a ground. As the current flows from tip 12 to end cap 54 an electrical arc is produced across the junction of the mechanical bond between the components. This electrical arc results in the generation of thermal energy. The generation of thermal energy is allowed to continue until the temperature at the junction reaches the melting point of inconel, about 1700° C. The passage of electrical current is thereafter terminated, however a compressive force is still applied to fixture 58 for about 116 milliseconds which results in a fusing of the platinum cap 54 to the tip 12 to complete the manufacture of the center electrode 20.

Figure 13:
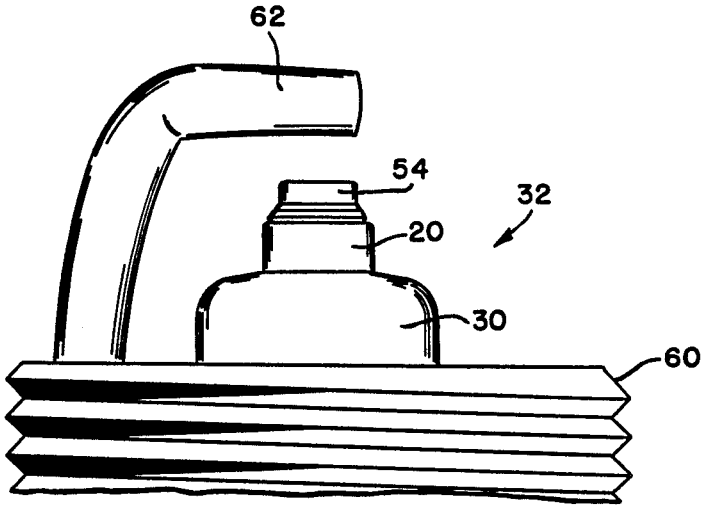
FIG. 13 is an enlarged view of a segment of a spark plug with an electrode made according to the method of manufacture disclosed herein.

This center electrode 20 is placed in a ceramic body 30 which is located in a metallic body 60 of a spark plug 32 as illustrated in FIG. 13. During operation, electricity flows from the center wire 20 through the platinum covered tip 12 to the edge electrode 62.

In test performed on a spark plug 32 made according to the process described above, the platinum end cap 54 was subjected to 750 hours of operation to simulate the operation of a vehicle. Visual inspection of the spark plug 32 did not reveal the formation of oxide or any other deterioration which would effect the flow of electricity between the center electrode 22 and edge electrode 62.

We claim:

1. A method of manufacturing an electrode for a spark plug comprising the steps of:

cutting a piece of inconel wire from a source to define a cylindrical blank having a first end and a second end;

placing said cylindrical blank in a first die, said first die forming an extruded tip on said first end;

placing said cylindrical blank in a second die, said second die forming an extruded cup in said cylindrical blank that extends from said second end toward said first end;

inserting a copper core in said cup;

placing said cylindrical blank and copper core in a die to extrude to a predetermined length between said first end and said second end for a resulting center wire;

punching a disc from a source of platinum;

placing said disc in a fourth die to produce a cap member;

placing said center wire and cap member in a first fixture where said cap member is placed on said tip;

transporting said center wire with cap member located on said tip to a second fixture;

applying a compressive force to said center wire and cap member while in said second fixture;

applying an electrical current to said center wire and cap member to cause an electrical current to flow across the junction between the surfaces on said tip and cap member whereby thermal energy is generated at said junction;

terminating the electrical current when said thermal energy reaches the melting point of inconel wire; and maintaining said compressive force on said center wire and cap member after termination of said electrical current causing fusion between said cap member and tip to complete the manufacture of said electrode.

2. The method of manufacturing an electrode for a spark plug as recited in claim 1 further comprising the step of:

cleaning oxidation from said tip prior to the placing of said cap member thereon.

3. The method of manufacturing an electrode for a spark plug as recited in claim 2 further comprising the step of:

establishing a flange on said cap member prior to placing of the cap member on said tip, said flange increasing the contact surface with said tip to provide for a stronger joint between cap member and tip.

4. The method of manufacturing an electrode for a spark plug as recited in claim 3 further comprising the step of:

stamping said disc to a thickness of about 0.003 inches, said thickness being sufficient to protect said tip from oxidation which could effect the passage of electrical current from the center wire to an electrical ground.

5. The method of manufacturing an electrode for a spark plug as recited in claim 4 wherein said first fixture moves said cap member toward said tip, said cap member being formed around said tip to form a mechanical bond therebetween.

6. A method of manufacturing an electrode for a spark plug comprising the steps of:

cutting a piece of inconel wire from a source to define a cylindrical blank having a first end and a second end;

placing said cylindrical blank in a first die to produce an extruded tip on said first end;

placing said cylindrical blank in a second die to produce an extruded cup that extends from said second end toward said first end;

inserting a copper core in said extruded cup;

placing said cylindrical blank with the copper core in a third die and further extruding the cylindrical blank and copper core to establish a predetermined length between said first end and said second end for a resulting center wire;

punching a disc from a source of platinum;

placing said center wire and disc in a fourth die;

moving said disc toward said first end until said disc surrounds said tip;

transporting said center wire with the platinum disc surrounding said tip to a welding fixture;

applying a compressive force to said first and second end causing said platinum disc to substantially engage said inconel tip;

passing electrical current through said cylindrical blank and said inconel disc to produce thermal energy at the junction of the disc and tip;

terminating the flow of electrical current when said thermal energy reaches the melting point of inconel; and maintaining said compressive force on said center wire and cap member after termination of said electrical current to allow said tip to fuse with said cap member to complete the manufacture of said electrode.

7. The method of manufacturing an electrode as recited in claim 6 further including the step of:

rolling said source of platinum to a thickness of between 0.003 to 0.005 inches prior to punching said disc.

8. The method of manufacturing an electrode as recited in claim 7 further including the step of:

cleaning oxide from said tip of the cylindrical blank prior to the attachment of said disc to improve the development of fusion between the inconel and platinum.

* * * * *